United States Patent [19]

Reynolds et al.

[11] 4,334,728

[45] Jun. 15, 1982

[54] ZERO INSERTION FORCE CONNECTOR CLIP ASSEMBLY

[75] Inventors: Charles E. Reynolds, Mechanicsburg; Robert N. Whiteman, Jr., Middletown, both of Pa.

[73] Assignee: AMP Incorporated, Harrisburg, Pa.

[21] Appl. No.: 147,667

[22] Filed: May 7, 1980

[51] Int. Cl.[3] ..... H01R 13/50

[52] U.S. Cl. ..... 339/74 R; 339/17 F; 339/176 MF

[58] Field of Search ..... 339/17 R, 176 MF, 74 R

[56] References Cited

U.S. PATENT DOCUMENTS

| | | | |
|---|---|---|---|
| 3,629,787 | 12/1971 | Wilson | 339/17 |
| 3,989,336 | 11/1976 | Rizzio et al. | 339/74 |
| 4,181,386 | 10/1978 | Olsson | 339/17 F |
| 4,252,389 | 2/1981 | Olsson | 339/17 F |
| 4,252,392 | 2/1981 | Whiteman, Jr. | 339/176 MF X |

*Primary Examiner*—John McQuade

*Assistant Examiner*—Frank H. McKenzie, Jr.

*Attorney, Agent, or Firm*—Frederick W. Raring

[57] ABSTRACT

Zero insertion force connector clip assembly for connecting conductors on a flexible film to conductors on a circuit board comprises a stamped and formed metallic clip and a lifting tool mounted on the clip. The clip has cantilever springs extending from one of its side edges towards the surface of the circuit board. The springs are arcuately formed to define bearing portions which bear against the circuit board conductors and each spring has a portion extending from the bearing portion towards the clip bar. Each spring also has a tool engageable section which extends substantially parallel to the clip bar. The lifting tool comprises a platelike member mounted against the clip bar having edge portions disposed between the end portions of the spring and the clip bar. The springs can be raised from the surface of the circuit board by manipulating the tool as a lever to raise the bearing portions of the springs so that a cable can be inserted beneath the bearing portions.

7 Claims, 7 Drawing Figures

ZERO INSERTION FORCE CONNECTOR CLIP ASSEMBLY

FIELD OF THE INVENTION

This invention relates to electrical connector clips for connecting conductors on a film such as a flexible cable to conductors on a circuit board.

BACKGROUND OF THE INVENTION

U.S. Pat. No. 4,181,386 discloses a stamped and formed electrical connector clip which is intended to be mounted on a circuit board in straddling relationship to a group of circuit board conductors. A plurality of springs extend from the clip and bear against the conductors on the circuit board so that conductors on a flexible cable can be electrically connected to the circuit board conductors by inserting the cable between the springs and the surface of the circuit board. The connector clip shown in U.S. Pat. No. 4,181,386 is such that the springs can be raised from the surface of the circuit board by the use of a suitable tool thereby to permit insertion of the cable under zero insertion force (ZIF) conditions, a desirable feature which minimizes the potential of damage to the film conductors.

Application Ser. No. 73,402 filed Sept. 7, 1979, now U.S. Pat. No. 4,252,392, shows a connector clip of the general class disclosed in the above identified patent having an integral lifting means assembled to the clip for raising the springs from the surface of the circuit board. The provision of a lifting means mounted on the connector clip eliminates the need of a specialized lifting tool when circuitry changes are to be made.

Connector clips, as disclosed in U.S. Pat. No. 4,181,386 are coming into widespread usage and there is increasing interest in clips having a lifting means mounted thereon, or assembled thereto, in accordance with the general teachings of U.S. Pat. No. 4,252,392. There is also a developing need for a connector clip capable of use under circumstances where a relatively large number of cable conductors or film conductors must be connected to an equal number of circuit board conductors, for example, where a cable having 20 conductors thereon must be connected to an equal number of conductors on a circuit board.

The present invention is directed to the achievement of an improved connector clip and a lifting tool which can be assembled to the clip, if desired, to permit insertion of the cable under ZIF conditions. A connector clip in accordance with the invention, can also be used with a separate lifting tool not mounted on the clip, if it is desired to discourage disengagement of a cable from a circuit board by unauthorized procedures or persons. The invention is further directed to the achievement of a connector clip which is capable of connecting a relatively large number of film conductors to an equal number of circuit board conductors.

One form of connector clip in accordance with the invention, comprises a stamped and formed sheet metal member having a rectangular clip bar and having mounting means extending from the ends of the clip bar for mounting the clip on the circuit board in straddling relationship to the circuit board conductors. A plurality of cantilever springs extend from one of the side edges of the clip bar and towards the circuit board conductors. These springs are arcuately formed to provide bearing portions which bear against the circuit board conductors and each spring has a portion extending from the bearing portion towards and past the clip bar. Each spring further has a tool engageable end portion which is proximate to the clip bar. A lifting tool which comprises a relatively simple rectangular member is moveably supported against a clip bar and has side portions that are received between the free end portions of the springs and the surface of the clip bar. When the clip is mounted on a circuit board, the lifting member can be manipulated in the manner of a lever of the second order to raise the free end portions of the springs and thereby raise the bearing portions of the springs from the surface of the circuit board. The cable or other film can then be inserted beneath the clip bar so that the circuit board conductors are in alignment with the film conductors. When the springs are allowed to return to their normal positions by further manipulation of the lifting tool, the springs bear against the film and thereby press the film conductors against the circuit board conductors. The connector clip, although metallic, does not serve an electrical function since the springs bear against the surface of the film rather than the conductors on the film. If desired, the lifting member need not be mounted on the clip but can be kept separate from the clip and held in custody only by those who are authorized to change the circuitry in which the clip is used.

PRACTICE OF THE INVENTION

Figure 1:
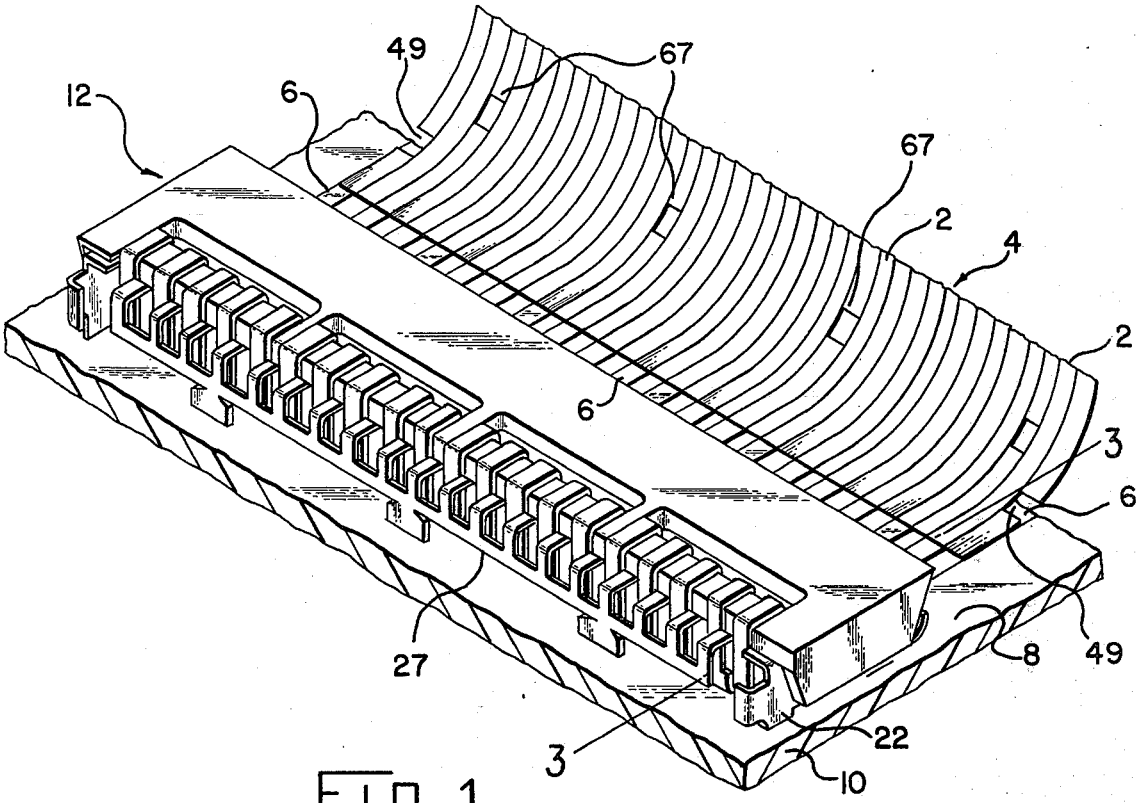
FIG. 1 is a perspective view of a portion of a circuit board having a connector clip assembly mounted thereon showing a cable in alignment with a clip in preparation for insertion of a cable between the clip and the surface of the circuit board.
Figure 2:
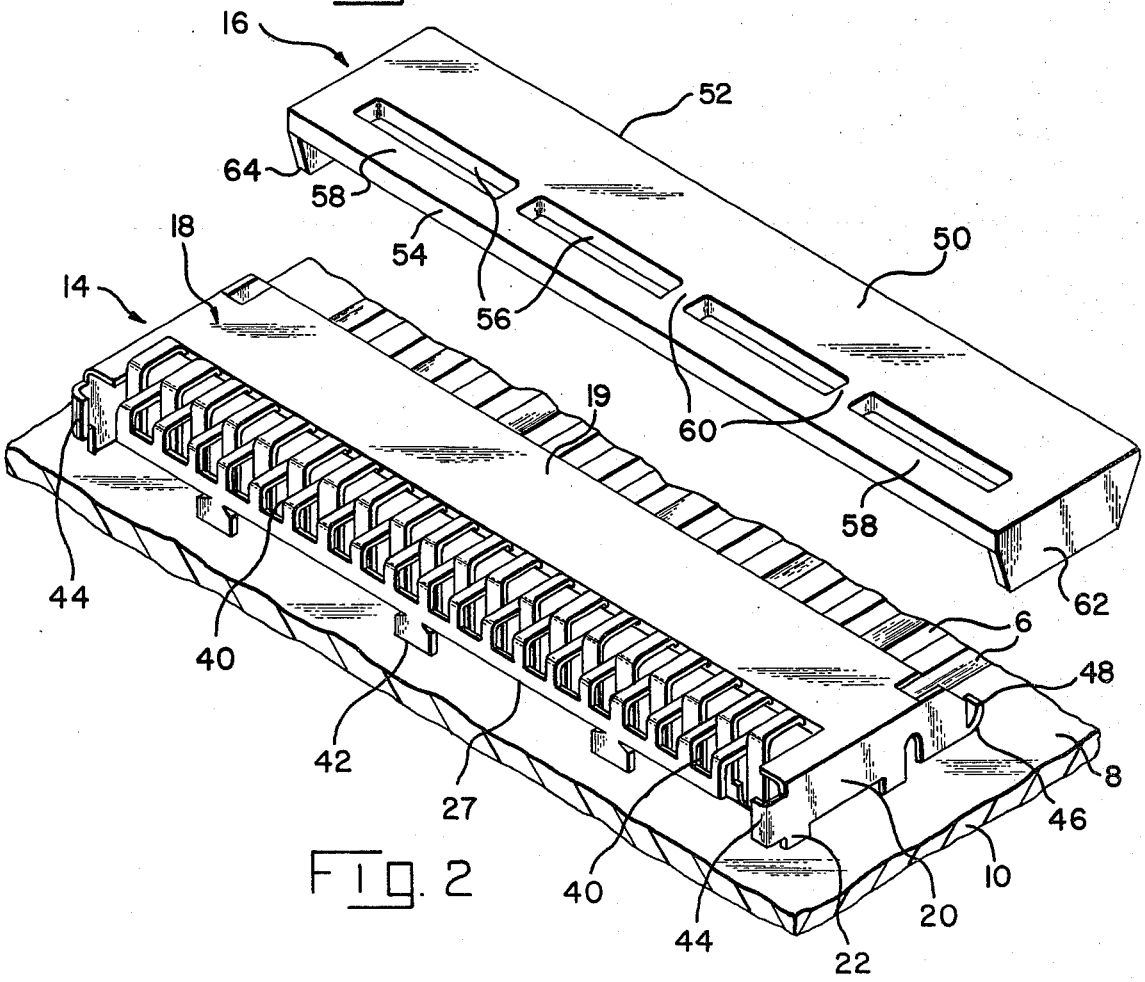
FIG. 2 is a view similar to FIG. 1 but showing the lifting tool exploded from the connector clip.
Figure 3:
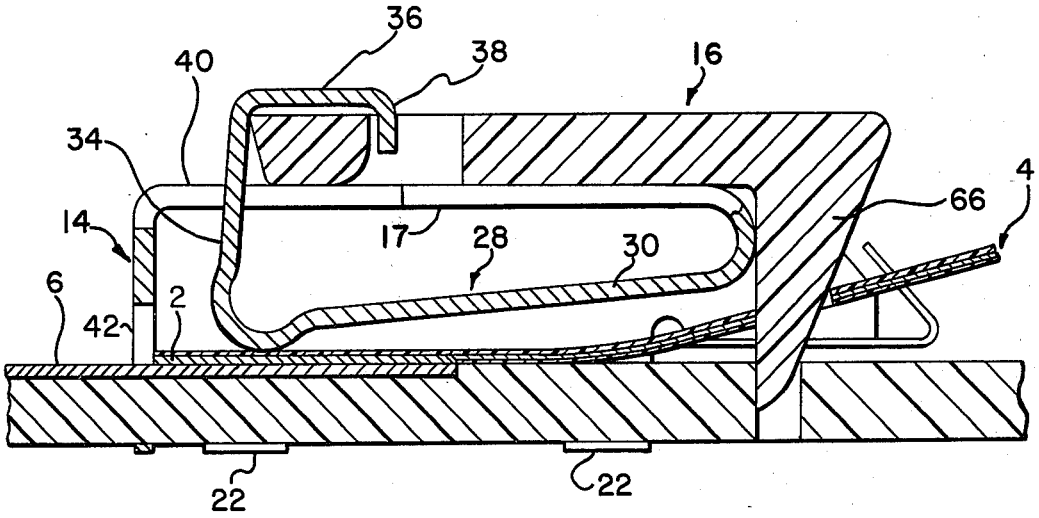
FIG. 3 is a cross-sectional view taken along the lines 3—3 of FIG. 1.

Referring first to FIGS. 1–3, a connector clip assembly 12 in accordance with the invention, serves to connect cable conductors 2 on the underside of a conductor cable 4 to spaced apart circuit board conductors 6 on the upper surface 8 of a circuit board 10.

The clip assembly 12 comprises a one-piece stamped and formed sheet metallic connector clip 14 and a one-piece lifting tool 16 which may be of metal or a suitable thermoplastic or other material. The connector clip 14 comprises a rectangular clip bar 18 having oppositely directed first and second surfaces 17, 19 and having flanges 20 extending from its ends. Mounting legs 22 extend from the edges of the flanges 20 and are adapted to enter holes in the circuit board, as shown. These mounting legs can be clinched over against the underside of the circuit board to hold the cable on the surface 8 in straddling relationship to the circuit board conductors 6.

The clip bar is formed downwardly, as viewed in the drawing, adjacent to one of its side edges 26 and a plurality of cantilever springs 28 extend from this first side edge obliquely away from the surface 17. These springs are arcuately formed, as shown at 32, to define bearing portions at the end of spring arm portions 30, these bearing portions being against the circuit board conductors when the clip is mounted on the circuit board, as shown in the drawing. Each spring has an upwardly extending portion 34 which extends towards the plane of the clip bar and through an opening 40 in the clip bar. Finally, each spring has a tool engageable free end portion 36 which is proximate to the surface 19, this free end portion being downwardly formed towards the clip bar on its end 38.

The openings 40, through which the springs extend, are arranged in a row adjacent to the second side edge 27 of the clip bar 18 and the clip bar is bent downwardly adjacent to this second edge to form an apron or flange, as shown in FIG. 1. Additional mounting members 42 extend from the side edge 27 and are also received in holes in the circuit board. The provision of these additional mounting members permits the clip bar to have a relatively long span so that connector clips, in accordance with this embodiment, can be made for relatively large numbers of circuit board and film conductors 2, 6.

The connector clip 14 has stop ears 44 extending inwardly from the flanges 20 adjacent to the edge 27 which serve as a stop for the leading end of the cable 4 when it is inserted beneath the springs. The clip also has extensions 46 on the flanges adjacent to edge 26 of the clip bar and ears 48 are provided on these extensions which are received in openings 49 in the cable, as shown. These ears on the clip and the openings in the cable function to some extent as a strain relief means for the cable and as a positioning means when the cable is inserted beneath the springs.

Figure 5:
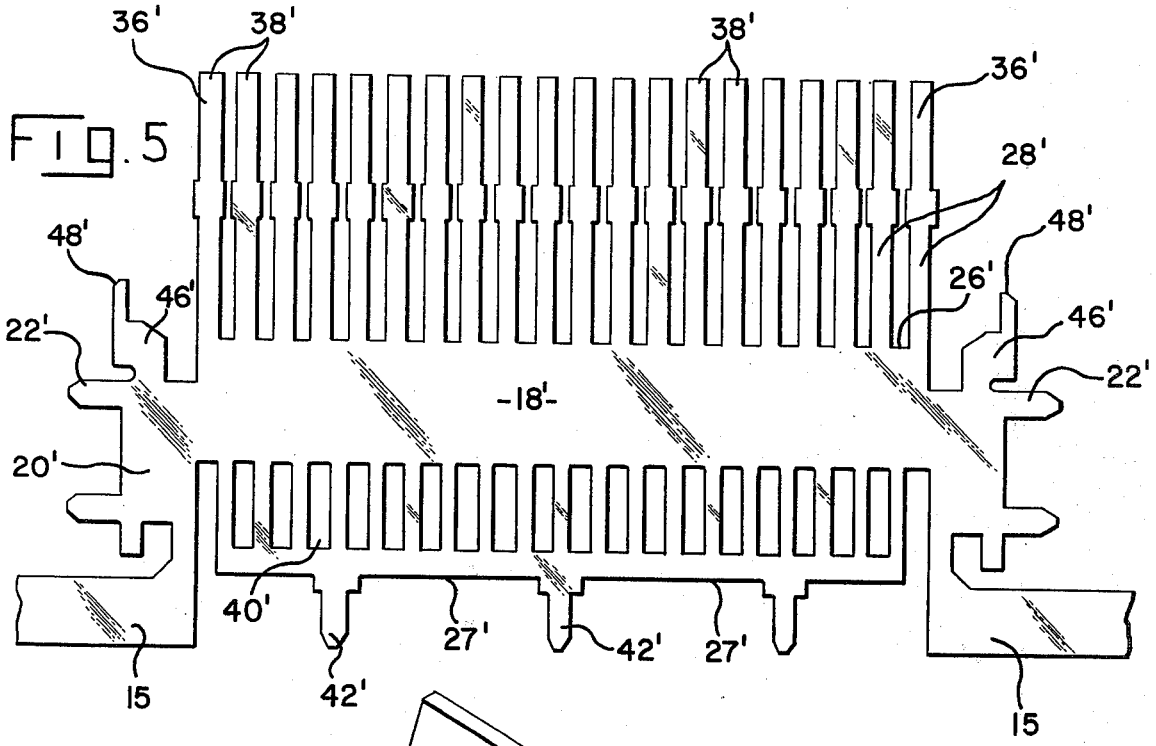
FIG. 5 is a plan view of the flat sheet metal blank from which the clip is formed.
Figure 6:
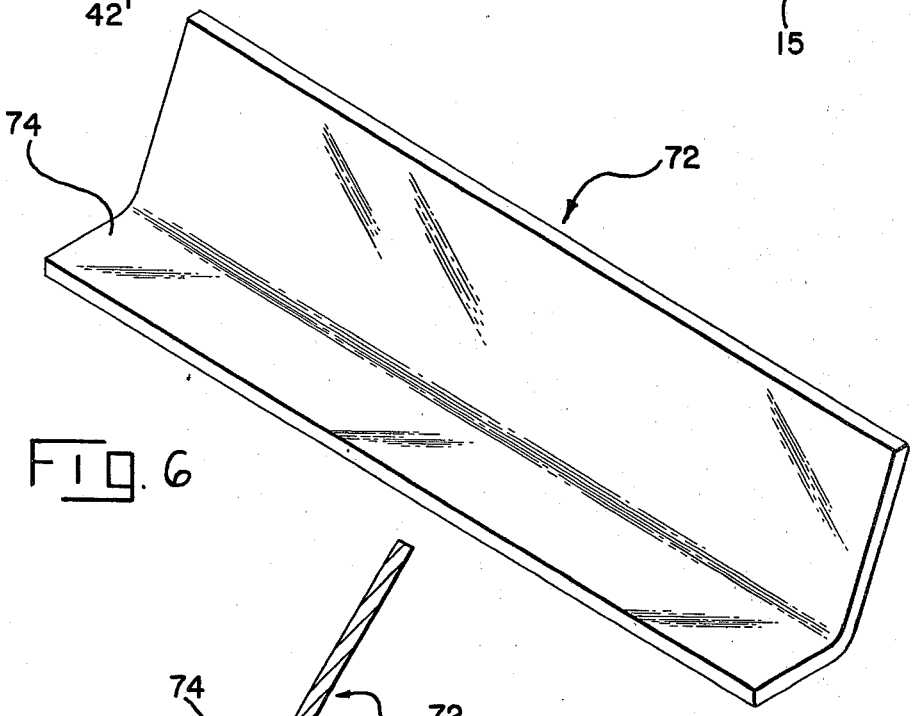
FIG. 6 is a perspective view of an alternative lifting tool.

The connector clip 14 is produced by stamping and forming strip metal having suitable spring properties, such as steel or brass. The connector clips are produced continuously in a stamping and forming die with each clip connected to the next adjacent clips by suitable connecting carrier strips 15, as shown in FIG. 5. The flat blank, FIG. 5, from which the clip is formed, shows all of the parts of the finished and formed clip 14 with the parts identified with the same reference numerals, differentiated by prime marks as are used in the foregoing description of the formed clip.

The lifting tool 16 comprises a generally rectangular plate-like member 50 which conforms in size and dimensions to the clip bar 18 and which has side edges 52, 54. Openings 56 are provided adjacent to the side edge 54 and these openings thus define lifting bar portions 58 which are connected to the main body of the member 50 by connecting sections 60. Flanges 62 extend downwardly from the ends of the rectangular member 50 and are contoured on their inner surfaces such that they will latch against outwardly facing side surfaces of the flanges 20 of the connector clip.

The lifting member is assembled to the connector clip by locating the lifting bar portions 58 of the rectangular member 50 beneath the free end portions 36 of the springs 28. This can be done by flexing the spring arms 30 towards the surface 17 until the free end portions 36 of the springs are moved away from the surface 19 by a distance sufficient to permit insertion of the lifting member beneath the free end portions of the springs. When the springs return to their normal positions, the downwardly formed ends 38 on the springs will extend into the openings 56 thereby to retain the lifting member on the connector clip.

The lifting member 62 has integral positioning legs 66 extending from its underside adjacent to its side edge 52. These legs 66 are received in additional positioning openings 67 in the cable, as shown in FIG. 1, to ensure correct location of the cable when it is inserted beneath the springs. To some extent, these legs 66 serve us an added strain relief means for the cable.

Figure 4:
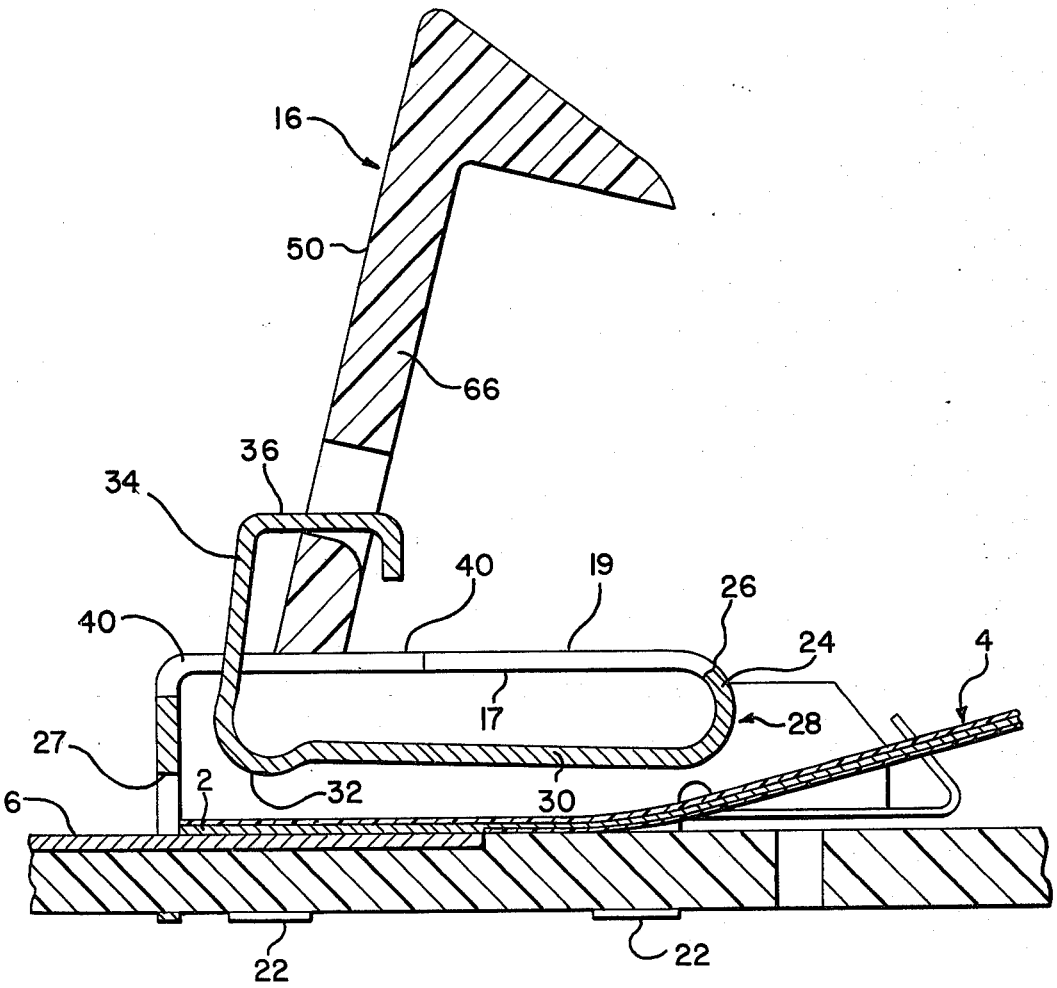
FIG. 4 is a view similar to FIG. 3 but showing the springs in their raised positions and showing the lifting tool in the position it occupies when the springs are raised from the surface of the circuit board.

In use, the assembly comprising the connector clip and the lifting member is mounted on the surface of the circuit board by inserting the mounting legs 22, 42 through appropriately located openings in the circuit board and clinching the legs against the underside of the board or soldering these legs to isolated metallized areas. When the clip is mounted on the circuit board, the springs will be preloaded against the circuit board conductors. When it is desired to connect the conductors 2 of the cable 4 to the circuit board conductors 6, the lifting member 16 is swung upwardly with the edge 54 thereof serving as a pivot axis. As shown bent in FIGS. 3 and 4, the edge 54 extends at an acute angle from the upper surface of the rectangular section 50 and when the lifting tool is in the raised position (FIG. 4) the rectangular section is inclined at an angle of less than 90 degrees to the clip bar 18. This feature discourages movement of the lifting tool over-center when it is raised. The lifting member functions as a lever of the second order in that it raises the portions 36 of the springs away from the clip bar and thereby raises the bearing portions 32 of the springs off the surface of the circuit board as shown in FIG. 4. The cable can then be inserted until the end of the cable is against the stop ears 22 and against the mounting members 42. The lifting member 16 is then swung downwardly until it is again parallel to the clip bar and the flanges 62 extend over the flanges 20 of the connector clip. The springs will then return to their preloaded conditions but will now bear against the insulation on the upper surface of the cable and press the exposed cable conductors 2 on the underside of the cable 4 against the circuit board conductors 6.

Figure 7:
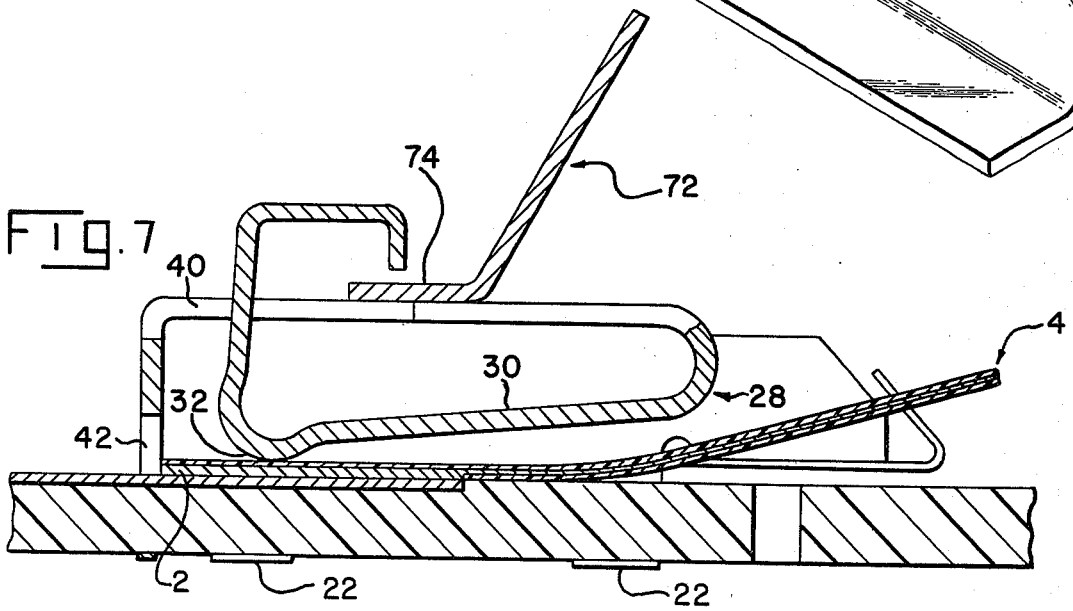
FIG. 7 is a view similar to FIG. 3 but illustrating the use of the alternative form of lifter.

The embodiment shown in FIGS. 1–5 is used when it is desired to have the capability of removing or inserting a cable without the requirement of special tools. Under many circumstances, however, it may be desired to avoid the experience of providing a lifting tool and/or to discourage the removal of a cable from beneath a connector clip or to discourage the connecting of cable conductors to circuit board conductors by unauthorized personnel. Under such circumstances, the connector clip 14 can be mounted on the surface of the circuit board without the lifting member 16 assembled to the clip, as shown in FIG. 7. The bearing portions 32 of the springs will bear against the circuit board conductors as described previously, but in the absence of the lifting member 16, it is difficult if not impossible to insert a cable between the bearing portions of the springs and the circuit board conductors. When the connector clip is used in this mode, a separate lifting tool 72 is provided, which is entrusted only to those authorized to use it. This lifting tool comprises a simple metallic plate having a lip 74 extending laterally from one side edge thereof. The lip and the tool are dimensioned such that the lip can be positioned beneath the end portions 36 of the springs and the plate-like tool member swung downwardly, with the clip bar serving as a support for the fulcrum of the tool, thereby to raise the springs from the surface of the circuit board as shown in FIG. 7. The lifting tool 72 functions as a first class lever rather than a second class lever.

If desired, the clip may be provided with an insulating coating to prevent the possibility of shorting in the event that the cable is defective. The clip may, alternatively, be rendered conductive by tin plating to provide a ground connection to one of the conductors of the cable (which would be exposed on its upper surface) or for other reasons.

What is claimed is:

1. A zero insertion force electrical connector clip for connecting spaced-apart film conductors on a film to spaced-apart circuit board conductors on a circuit board, said zero insertion force electrical connector clip being of the type comprising a stamped and formed member having a rectangular clip bar, said clip bar having oppositely directed first and second major surfaces, having mounting and supporting means extending from the ends thereof and having first and second side edges extending between said ends, and a plurality of spaced apart cantilever springs extending from said first side edge, said springs having spring arm portions and having bearing portions on said spring arm portions which are between said mounting means and are spaced from said first major surfaces, said clip being characterized in that:

said springs extend from said bearing portions towards said clip bar and beyond said second major surface of said clip bar, said springs having free end portions which are proximate to said second major surface, and spring lifting means on said second major surface extending between said free ends of said springs and said second major surface, said lifting means comprising a member movably mounted relative to said clip bar and effective upon movement to move said free ends away from said second major surface whereby, upon mounting said clip on said circuit board in straddling relationship to said circuit board conductors, said bearing portions of said springs will bear against said circuit board conductors, and said springs can be lifted from said circuit board by said lifting means to permit positioning of said film beneath said springs whereby upon return of said springs to their normal positions, said film conductors will be pressed against said circuit board conductors by said springs.

2. A zero insertion force electrical connector clip as set forth in claim 1, said lifting means comprising a lever movably mounted on said clip bar.

3. A zero insertion force electrical connector clip as set forth in claim 2, said lever comprising a second order level disposed on said second major surface.

4. A zero insertion force electrical connector clip as set forth in claim 1, said clip bar having opening means therein proximate to, and extending beside, said second side edge, said springs extending from said bearing portions through said opening means.

5. A zero insertion force electrical connector clip as set forth in claim 4, said clip having additional mounting and supporting means extending from central portions of said second side edge for supporting central portions of said clip bar.

6. A zero insertion force electrical connector clip as set forth in claim 5, said spring lifting means comprising a second order lever disposed against said second major surface.

7. A zero insertion force electrical connector clip as set forth in claim 6, said lever comprising a plate-like member having one side edge which extends parallel to, and adjacent to, said second side edge of said clip bar, said free end portions of said springs extending past said one side edge of said member and extending over surface portions of said member.

* * * * *